US007322196B2

(12) United States Patent
Tiemann

(10) Patent No.: US 7,322,196 B2
(45) Date of Patent: Jan. 29, 2008

(54) COMBUSTION CHAMBER FOR COMBUSTING A COMBUSTIBLE FLUID MIXTURE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 731 days.

(21) Appl. No.: 10/672,506

(22) Filed: Sep. 26, 2003

(65) Prior Publication Data

US 2005/0097894 A1 May 12, 2005

(30) Foreign Application Priority Data

Nov. 22, 2002 (EP) ..... 02026101

(51) Int. Cl.
*F23M 5/04* (2006.01)

(52) U.S. Cl. ..... 60/752

(58) Field of Classification Search ..... 60/758, 60/752, 800; 110/336, 332, 331
See application file for complete search history.

(56) References Cited

U.S. PATENT DOCUMENTS

| | | | | |
|---|---|---|---|---|
| 2,155,165 | A * | 4/1939 | Heuer | 110/332 |
| 2,463,217 | A * | 3/1949 | Tonneson | 110/336 |
| 2,548,485 | A | 4/1951 | Lubbock | |
| 2,634,694 | A * | 4/1953 | Hazen | 110/331 |
| 3,328,014 | A * | 6/1967 | Longenecker | 432/238 |
| 4,246,852 | A * | 1/1981 | Werych | 110/336 |
| 4,840,131 | A | 6/1989 | Meumann et al. | |
| 5,957,067 | A * | 9/1999 | Dobbeling et al. | 110/336 |
| 2002/0056277 | A1 | 5/2002 | Parry | |

FOREIGN PATENT DOCUMENTS

| | | |
|---|---|---|
| DE | 36 25 056.2 | 1/1988 |
| DE | 39 40 381.5 | 6/1991 |
| DE | 43 09 200.4 | 9/1994 |

* cited by examiner

*Primary Examiner*—Michael Koczo, Jr.

(57) ABSTRACT

A combustion chamber (1) for combusting a combustible fluid mixture having a burner (2) disposed on the combustion chamber (1) and a method for cooling a combustion chamber (1). A fixing device is provided for liner elements (5) of a combustion chamber (1) by which simplified assembly from the inside of the liner (4) can be achieved. The combustion chamber has a burner (2) disposed on the combustion chamber (1), a liner (4) disposed in the combustion chamber (1), and an outlet opening (3), wherein the liner (4) includes liner elements (5) which are elastically fixable to a combustion chamber casing (7) by rail elements (6), the rail elements (6) being disposed on the combustion chamber side and projecting outward between two adjacently disposed liner elements (5).

12 Claims, 4 Drawing Sheets

COMBUSTION CHAMBER FOR COMBUSTING A COMBUSTIBLE FLUID MIXTURE

CROSS REFERENCE TO RELATED APPLICATIONS

This application claims the benefits of European application No. 02026101.2 EP, filed Nov. 11, 2002, which is incorporated by reference herein in its entirety.

FIELD OF INVENTION

The present invention relates to a combustion chamber for combusting a combustible fluid mixture having a burner disposed on the combustion chamber. The invention further relates to a method for cooling a combustion chamber according to the invention.

BACKGROUND OF INVENTION

Combustion chambers, particularly for gas turbines, are usually provided internally with a flow control body which is referred to as a liner. Basically, different concepts for combustion chamber arrangements are known. Thus, for example, combustion chamber arrangements are used which are composed of a plurality of individual combustion chambers (cans) which culminate in a common opening. In the case of a gas turbine the opening is preferably implemented as an annular opening which simultaneously constitutes the transition to the turbine room. A burner provided in the combustion chamber is supplied with a combustible fluid mixture which ignites in the combustion chamber and, flowing through the liner, is routed in the direction of the outlet opening. Another concept of a combustion chamber arrangement provides a single ring-shaped annular combustion chamber instead of a plurality of individual combustion chambers. A combustible fluid mixture ignited in burners is introduced into an annular combustion chamber of this kind, combusts in the chamber and expands in the direction of the outlet opening.

Since the walls of the combustion chamber are exposed to high thermal loads on account of the combustion taking place in the interior of the combustion chamber, these parts of the combustion chamber must be cooled. This is usually achieved by means of slits through which a coolant is channeled, said coolant convectively cooling the combustion chamber.

The liner disposed in the interior of the combustion chamber in particular is exposed to high physical stress, which is why this liner is subject to wear and tear. An arrangement is therefore provided which enables the liner, particularly parts thereof, to be replaced. For this purpose there are disposed in the prior art rail-like rods via which the individual liner elements are connected to the wall of the combustion chamber. The rails disposed between the liner and the casing are in fact located in a comparatively cool area of the combustion chamber, with the result that disassembly from the inside cannot easily be carried out. All in all, however, the liner too is very complicated to manufacture due to the fixing toward the interior. Furthermore, thermal voltages are produced on account of the very high sidewalls.

SUMMARY OF INVENTION

The object of the invention is therefore to provide a fixing device for liner elements of a combustion chamber by means of which simplified assembly from the interior of the liner can be achieved.

To achieve this object there is proposed according to the present invention a combustion chamber of the generic type having a burner disposed at the combustion chamber, a liner disposed in the combustion chamber and an outlet opening, the liner having liner elements which can be elastically secured by means of rail elements to a combustion chamber casing, the rail elements being disposed on the combustion chamber side and projecting outward between two liner elements disposed adjacent to each other.

For the first time the rails are disposed on the hot gas side and form part of the internal wall of the combustion chamber. As a result the liner joints face outward, thereby enabling the liner to be realized as a more simple and also a flatter design. Furthermore, internal stresses can be reduced. Disassembly of the liner elements toward the inside as well as assembly of the liner elements from the inside can be achieved.

It is further proposed that the liner element can be secured by means of a fixing element provided on the outside on the rail element. In this way standard fixing means can advantageously be used in order to secure the liner elements to the rail elements. Costs and assembly effort can be reduced.

It is additionally proposed that the fixing element is formed by means of a screw. In this way it is possible to achieve a separable connection which can be implemented by means of conventional, known tools. Special tools for carrying out the fixing can be avoided.

It is moreover proposed that the fixing element is formed by a clamping element, particularly a clamping spring. Particularly easy and quick assembly and disassembly of liner elements can be achieved through the use of clamping springs. This has a particularly advantageous effect when the downtime of an installation such as a gas turbine, for example, constitutes a significant cost factor. Short downtimes can be achieved.

In a further embodiment it is proposed that the rail element has a coating at least on the combustion chamber side. On the one hand the coating can lead both to a reduction in physical stresses during normal operation and also to a reduction in wear and tear. Maintenance intervals can be extended. It is, however, also possible for a coating to be provided in order, for example, to form an inert surface in relation to the fluid contained in the combustion chamber. The rail element can also be provided with a coating over its entire surface area in order, for example, to simplify a coating process.

In order to cool the rail elements it is proposed that the rail element comprises liner-like lugs in order to establish a fluidic connection between a channel of the rail element and a channel of the liner element for a coolant. A cooling system can advantageously be achieved which simultaneously permits cooling of the liner elements and also of the rail elements.

Furthermore it is proposed that the combustion chamber has a closed-circuit cooling system. This enables the coolant to be advantageously supplied to the combustion chamber, the energy which it has absorbed in the course of the cooling function being fed back again to the process. In this way energy loss due to the cooling function can be reduced on the one hand and on the other hand the coolant can be used for combustion in the combustion chamber. A high level of efficiency can be achieved.

In a further embodiment it is proposed that the combustion chamber is disposed in a fluid-flow machine, particularly a gas turbine. Maintenance costs and downtimes of a gas turbine can be further reduced.

Further proposed with the invention is a method for cooling a combustion chamber according to the invention, wherein a coolant flowing through the liner rail flows at least partially in the circumferential direction of the combustion chamber in the direction of the liner element and is redirected in a channel of the liner element into or against the flow direction of the combustion chamber. A channel provided in a liner element, said channel being provided for example for cooling the liner element, can advantageously be used to discharge the coolant flowing through the liner rail. Thus, particularly in the case of a closed-circuit cooling system for a combustion chamber, the time and costs involved in designing the flow control of the coolant can be reduced. The number of components and assembly costs can also be reduced if, for example, a separate cooling fluid outlet can be saved.

In an advantageous embodiment of the present invention it is proposed that air be used as the coolant. Thus, a portion of the intake air, for example in the case of a gas turbine, can advantageously be tapped off and used for cooling. The portion of the air used for cooling is particularly advantageously fed back to the combustion chamber again such that on the one hand the heat absorbed by the cooling function and on the other hand the energy used to provide the cooling air can be returned at least partially to the process. A further increase in efficiency can be achieved.

Further details, features and advantages of the invention are detailed in the following description of an exemplary embodiment. Essentially identical components are designated by the same reference characters. With regard to identical features and functions, reference is further made to the description of the exemplary embodiment in FIG. 1.

DETAILED DESCRIPTION OF INVENTION

Figure 1:
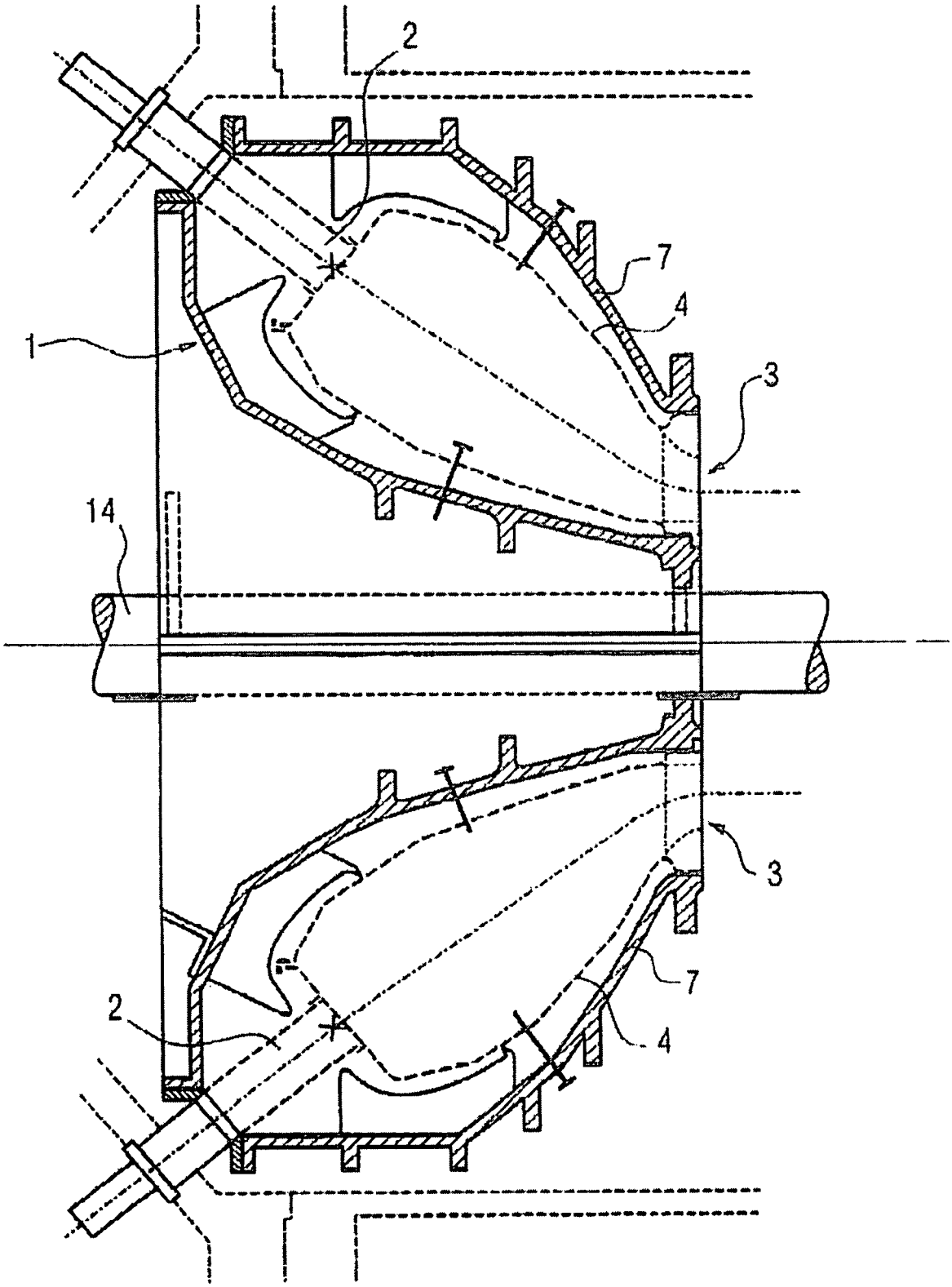
FIG. 1 shows a cross-section through an annular combustion chamber of a gas turbine that is not described in further detail.
Figure 2:
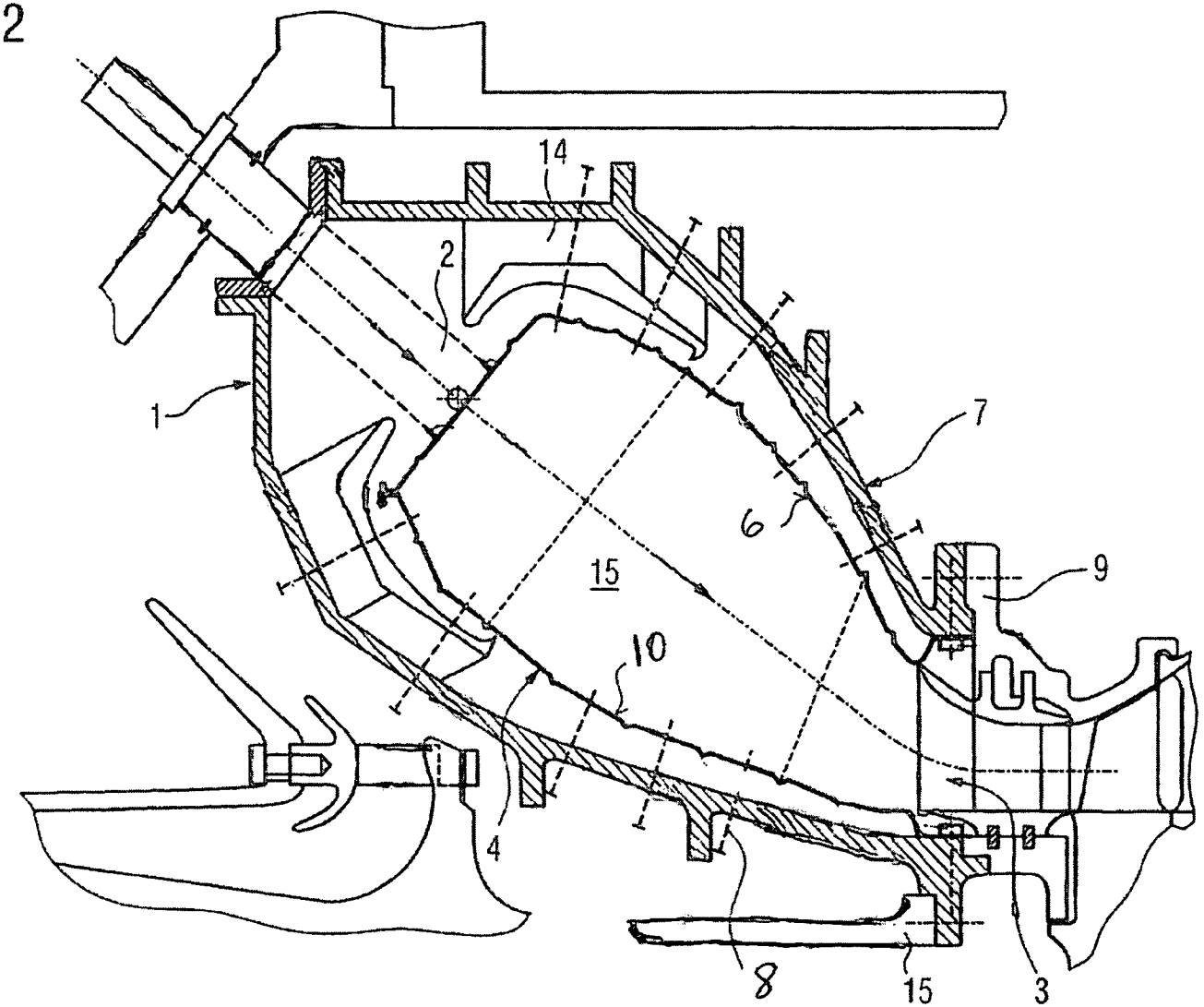
FIG. 2 shows a magnified representation of the upper part of the annular combustion chamber shown in FIG. 1.

FIG. 1 shows a section of a gas turbine comprising a combustion chamber 1 according to the invention, which in the present case is implemented as an annular combustion chamber. The combustion chamber 1 has a casing 7 in which a liner 4 is disposed. Opening at one end of the liner 4 is a burner 2 via which a combustible fluid is supplied. At the opposite end of the liner there is provided an outlet opening 3 which is connected to an inlet to a flow channel of a downstream gas turbine which is not described in further detail. A rotor shaft 14 is disposed centrally. FIG. 2 shows a section through the upper part of the combustion chamber 1 on a larger scale. The combustible fluid supplied via the burner 2 is ignited in a combustor 15 in the liner 4 and flows in the direction of the outlet opening 3 to the following turbine.

Figure 3:
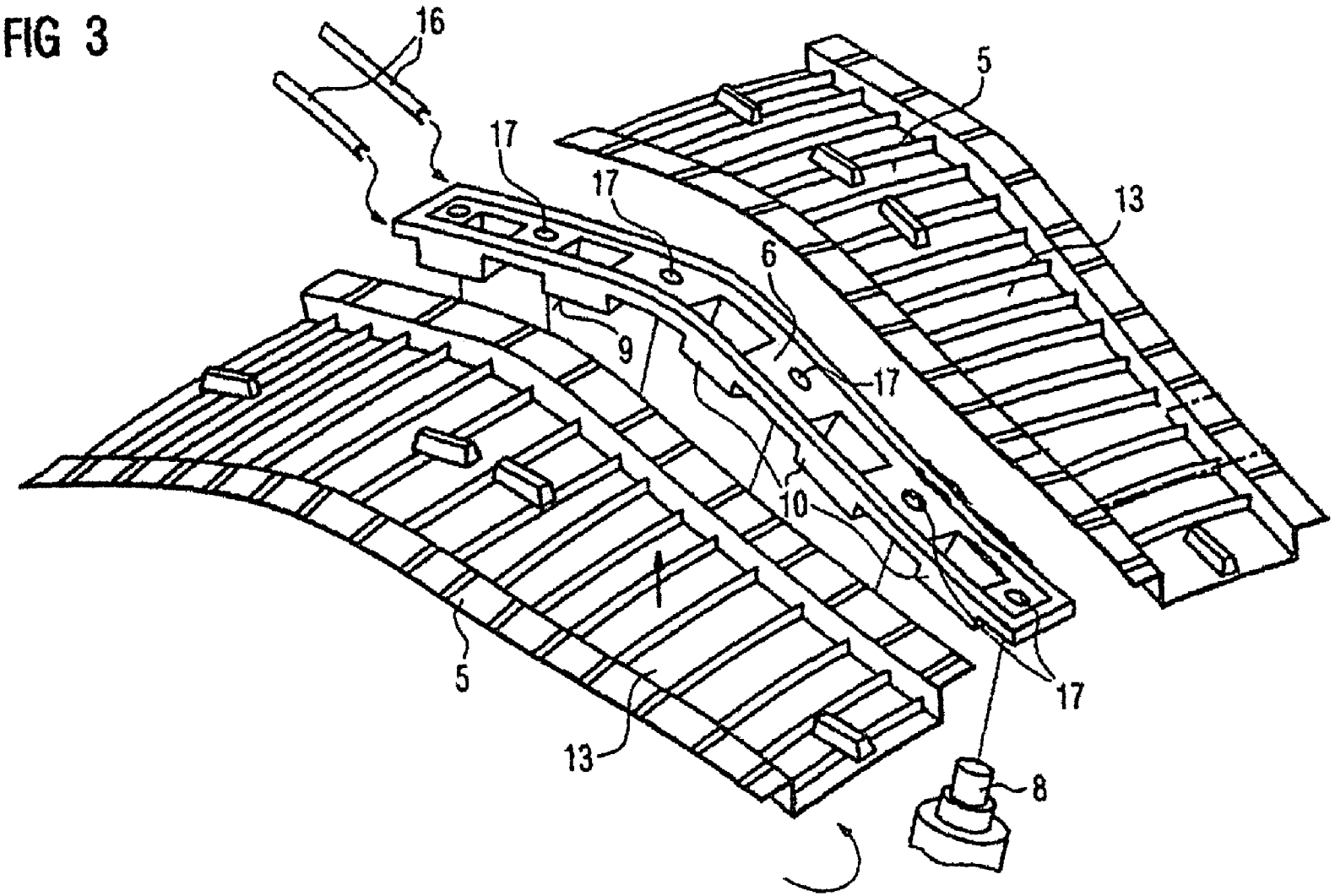
FIG. 3 shows a schematically perspective view of a rail element for connecting two adjacently disposed liner elements.

The liner 4 is constructed in the form of segments from liner elements 5 which are connected to one another adjacently in each case via rail elements 6 (FIG. 3). At the same time the liner elements 5 are elastically fixed to the combustion chamber casing 7 of the combustion chamber 1 via the rail elements 6. According to the invention, the rail elements 6 are disposed on the combustion chamber side and project outward between two adjacently disposed liner elements 5. For fixing purposes the rail element 6 has openings 17 through which a fixing device 8 can be introduced via which the rail element 6 is elastically secured to the casing 7 of the combustion chamber 1. To compensate for any expansions that occur the fixing devices 8 are implemented elastically in their longitudinal extension. A sealing element 16 is provided in each case to form a seal between the rail element 6 and the liner element 5.

Figure 4:
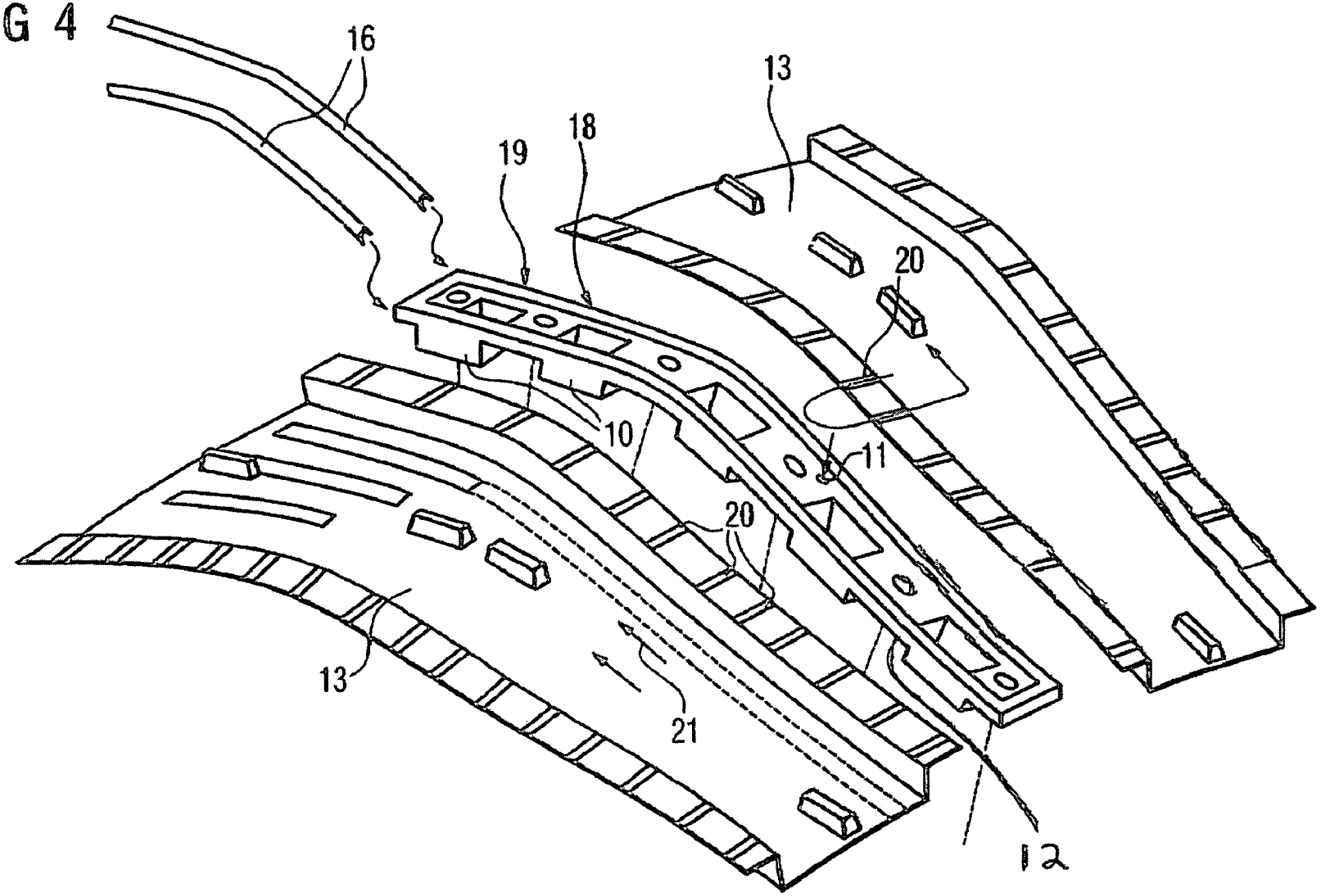
FIG. 4 shows a schematic representation of the coolant flow for cooling the arrangement according to the invention.

The rail element 6 is supported on the hot gas side between the two adjacent liners 5 on external liner hooks (not shown) and holds the liner elements 5 tight. The rail element 6 further comprises alternately staggered fixing sections and cooling sections alternating over its longitudinal extension. Further provided in the rail element are openings 11 via which a coolant flows from the rail element 6 via a channel 20 provided in an edge area of the liner element 5 into the channel 13 of the liner element 5. The coolant introduced through the channel 20 is also redirected into the flow direction 21 by means of coolant flowing against the flow direction of the combustion chamber in this embodiment in the channel 13 (FIG. 4). On the combustion chamber side the rail element 6 is provided with a coating 9 which effects a thermal insulation with respect to the hot gas flow inside the combustion chamber 1. At the same time the coating 9 forms a protection by means of which the aging of the rail element 6 is reduced. To provide the fluidic connection between the coolant channel 12 of the rail element 6 and the coolant channel 13 of the liner element 5 the rail element 6 has liner-like lugs in which the liner elements 5 are secured to the casing 7 of the combustion chamber 1. The coolant flow is discharged by these in the circumferential direction into the liner elements 6. As a result the area to be cooled is advantageously subdivided into fixing sections 19, through which the flow is in the circumferential direction, and cooling sections 18, through which the flow proceeds axially.

The coolant used in this embodiment is air which is taken from behind an intake compressor of the gas turbine (not shown) and supplied to the cooling system of the gas turbine. The gas turbine has a combustion chamber with a closed-circuit cooling system such that the air extracted from the process for cooling purposes can be fed back again in the combustion chamber. The thermal energy absorbed by the cooling function is thus returned to the process.

The exemplary embodiment illustrated in the figures serves simply to explain the invention and is not restrictive of the invention as claimed. Thus, for example, the shape and design of the liner elements and the rail elements in particular may vary.

The liner-like lugs 10 protrude from rail elements 6, as shown in FIGS. 3 and 4. The rail element 6 is secured to the casing 7 of the combustion chamber 1, as shown in FIG. 2. The rail element 6 is also sealed against the liner elements 5 by sealing element 16, as shown in FIGS. 3 and 4, thus the liner elements 5 are secured to the casing 7 via their attachment to the rail element 6.

The invention claimed is:

1. A combustion chamber for combusting a combustible fluid mixture comprising:

a burner disposed on the combustion chamber;

a liner disposed in the combustion chamber; and an outlet opening disposed on the combustion chamber, wherein the liner comprises a plurality of liner elements which are elastically fixable to a combustion chamber casing by rail elements disposed on the combustion chamber side of the combustion casing, the rail elements attached to adjacently disposed liner elements, wherein the rail elements include liner-like lugs, rail element coolant channels, and rail element openings, wherein the liner elements include liner element coolant channels, wherein the liner elements are secured to the rail elements by the liner-like lugs, and wherein the rail element coolant channels provide a fluidic connection between the rail element openings and the liner element coolant channels.

2. The combustion chamber according to claim 1, wherein the liner element is secured by a fixing element on the rail element.

3. The combustion chamber according to claim 2, wherein the fixing element comprises a screw.

4. The combustion chamber according to claim 1, wherein the rail element is cooled.

5. The combustion chamber according to claim 1 wherein the combustion chamber has a closed circuit cooling means for cooling the combustion chamber liner using coolant channels.

6. The combustion chamber according to claim 1, wherein the combustion chamber is disposed in a gas turbine.

7. A combustion chamber liner adapted for use within a gas turbine engine comprising a plurality of liner segments surrounding the combustion chamber, each liner segment having a liner element elastically fixable to the combustion chamber by a rail element that projects outward between two adjacently disposed liner elements, the rail elements being further disposed on the combustion chamber side of the combustion casing, wherein the rail element includes liner-like lugs, rail element coolant channels, and rail element openings, wherein the liner elements include liner element coolant channels, wherein the liner elements are secured to the rail elements by the liner-like lugs, and wherein the rail element coolant channels provide a fluidic connection between the rail element openings and the liner element coolant channels.

8. The combustion chamber liner of according to claim 7, wherein the liner element is secured by a fixing element on the outside of the rail element.

9. The combustion chamber liner according to claim 7, wherein the fixing element comprises a screw.

10. The combustion chamber liner according to claim 7 wherein the rail element is cooled.

11. The combustion chamber liner according to claim 7 wherein the combustion chamber has a closed-circuit cooling means for cooling the combustion chamber liner using coolant channels.

12. The combustion chamber liner according to claim 7 wherein the combustion chamber is disposed in a gas turbine.

* * * * *